US005211357A

United States Patent [19]

Leidenberger

[11] Patent Number: 5,211,357

[45] Date of Patent: May 18, 1993

[54] AIRBORNE BODY WITH STABILIZING FINS

[75] Inventor: Thomas Leidenberger, Nurnberg, Fed. Rep. of Germany

[73] Assignee: Diehl GmbH & Co., Nuremberg, Fed. Rep. of Germany

[21] Appl. No.: 897,366

[22] Filed: Jun. 11, 1992

[30] Foreign Application Priority Data

Jun. 14, 1991 [DE] Fed. Rep. of Germany ..... 4119613

[51] Int. Cl.[5] ..... F42B 10/14

[52] U.S. Cl. ..... 244/3.28; 244/49

[58] Field of Search ..... 244/3.26, 3.27, 3.28, 244/3.29, 3.3, 49

[56] References Cited

U.S. PATENT DOCUMENTS

| | | | |
|---|---|---|---|
| 4,143,838 | 3/1979 | Holladay | 244/3.28 |
| 4,728,058 | 3/1988 | Brieseck et al. | 244/3.28 |
| 4,860,969 | 8/1989 | Muller et al. | 244/3.28 |
| 5,108,051 | 4/1992 | Montet et al. | 244/3.28 |
| 5,114,095 | 5/1992 | Schroppel et al. | 244/3.28 |

FOREIGN PATENT DOCUMENTS

| | | | |
|---|---|---|---|
| 2342783 | 3/1975 | Fed. Rep. of Germany . | |
| 634090 | 3/1950 | United Kingdom | 244/3.28 |

*Primary Examiner*—Harold J. Tudor

*Attorney, Agent, or Firm*—Scully, Scott, Murphy & Presser

[57] ABSTRACT

An airborne body possessing stabilizing fins or control surfaces, wherein each stabilizing fin is displaceable about an associated bearing axle between a retracted inoperative position and a position of flight in which it is unfolded from the airborne body. An arrangement is associated with each stabilizing fin or control surface, which arrangement is provided for the damping or cushioning of the extending movement of the respective stabilizing fin from the inoperative position into the flying position and for the latching of the stabilizing fin in the flying position, while inhibiting and rebounding of the fin.

2 Claims, 4 Drawing Sheets

AIRBORNE BODY WITH STABILIZING FINS

BACKGROUND OF THE INVENTION

1. Field of the Invention

The present invention relates to an airborne body possessing stabilizing fins or control surfaces, wherein each stabilizing fin is displaceable about an associated bearing axle between a retracted inoperative position and a position of flight in which it is unfolded from the airborne body.

2. Discussion of the Prior Art

An airborne body of that type is known, for example, from the disclosure of U.S. Pat. No. 4,860,969, assigned to the common assignee of this application, and incorporated herein by reference. In that instance, it is a particular object to be able to implement a simultaneous unlatching of all control surfaces.

When the stabilizing fins or control surfaces of an airborne body of the above-mentioned type are extended into a flying position in which the stabilizing fins are unfolded from the airborne body either mechanically, pyrotechnically or due to the action of the spin of the airborne body, or in any other manner from their retracted inoperative position, upon reaching their operative position; in essence, their flying position, the stabilizing fins or control surfaces are in possession of so much kinetic energy, that a recoiling or rebounding of the stabilizing fins from their flying position in the direction towards their inoperative retracted position cannot be precluded with any certain degree of reliability. However, such a potential recoiling or rebounding of the stabilizing fins is not desired, or is not even at all permissible, due to reasons in adversely affecting the functioning of the airborne body.

SUMMARY OF THE INVENTION

In view of the foregoing, it is an object of the present invention to provide an airborne body of the above-mentioned type in which any recoiling or rebounding of the stabilizing fins or control surfaces from their extended flying position in a direction towards their inoperative position can be dependably avoided through the incorporation of simple measures.

This object is inventively attained in an airborne body of the above-mentioned type in that an arrangement is associated with each stabilizing fin or control surface, which arrangement is provided for the damping or cushioning of the extending movement of the respective stabilizing fin from the inoperative position into the flying position and for the latching of the stabilizing fin in the flying position.

With the aid of the damping arrangement or, in essence, latching device which is associated with each stabilizing fin there is obtained the advantage that the kinetic energy which is present in each stabilizing fin will be attenuated in a defined manner during the movement of the respective stabilizing fin from its retracted inoperative position into the flying position in which it is unfolded from the airborne body; in effect, the fin will be retained in the flying position in which it is unfolded from the airborne body.

The defined or selected latching of the stabilizing fins in the flying position in which they are extended or unfolded from the airborne body also remains maintained even during a rotation of the shaft of the control surface or fin, when the damping or, in essence, latching arrangement, at an applicable construction of the inventive airborne body, is located on the respective shaft of the stabilizing fin or control surface.

A further advantage consists of in that the stabilizing fins, subsequent to their unfolding into the flying position, are positioned so as to be precisely defined, and maintained in the flying position in the absence of any play, which is required due to aerodynamic reasons.

A further advantage of the inventive airborne body consists of in that, for purposes of testing, it is possible with a low demand on energy and with simple auxiliary means, to unlatch the stabilizing fins in case of need, without this rendering it necessary to have to undertake complicated disassembling procedures on the airborne body. Through the resilient or inherent spring characteristic of the damping arrangement or; in effect, of the latching arrangement, or of each of a plurality of such arrangements, as has already been mentioned, there is attenuated or essentially restrained the recoiling or rebounding energy of every stabilizing fin or control surface, in consequence of which the danger of breaking of the above-mentioned arrangement is negligibly low and there is accordingly afforded a high operational reliability even under extreme environmental conditions, such as high or low temperatures, dust or the like. Through a suitable construction and dimensioning of the damping or latching arrangement, it is possible to dependably cover; in effect, absorb and attenuate a broad spectrum of differently high impact energies of the stabilizing fins in their flying position in which they are unfolded from the airborne body.

Further advantages reside in the reliable operating characteristics which are evident through the adjustable positioning accuracy of the stabilizing fins or control surfaces in the flying position which is specified by the exact measurements of the damping or, in essence, latching arrangements; in the simple mounting for the expendiently producible damping or latching arrangements, the latter of which are preferably constructed from stamped sheetmetal and bent components, and which require only a small amount of space and possesses a low weight; as well as in the reusability of the above-mentioned arrangement. Furthermore, through the use of these arrangements there is obtained a freedom from the need for maintenance, inasmuch as; for instance, there is no requirement for any lubrication.

BRIEF DESCRIPTION OF THE DRAWINGS

Further details, features and advantages may now be more readily ascertained from the following description of an exemplary embodiment of the inventive airborne body with stabilizing fins, taken in conjunction with the accompanying drawings; in which.

DETAILED DESCRIPTION

Figure 1:
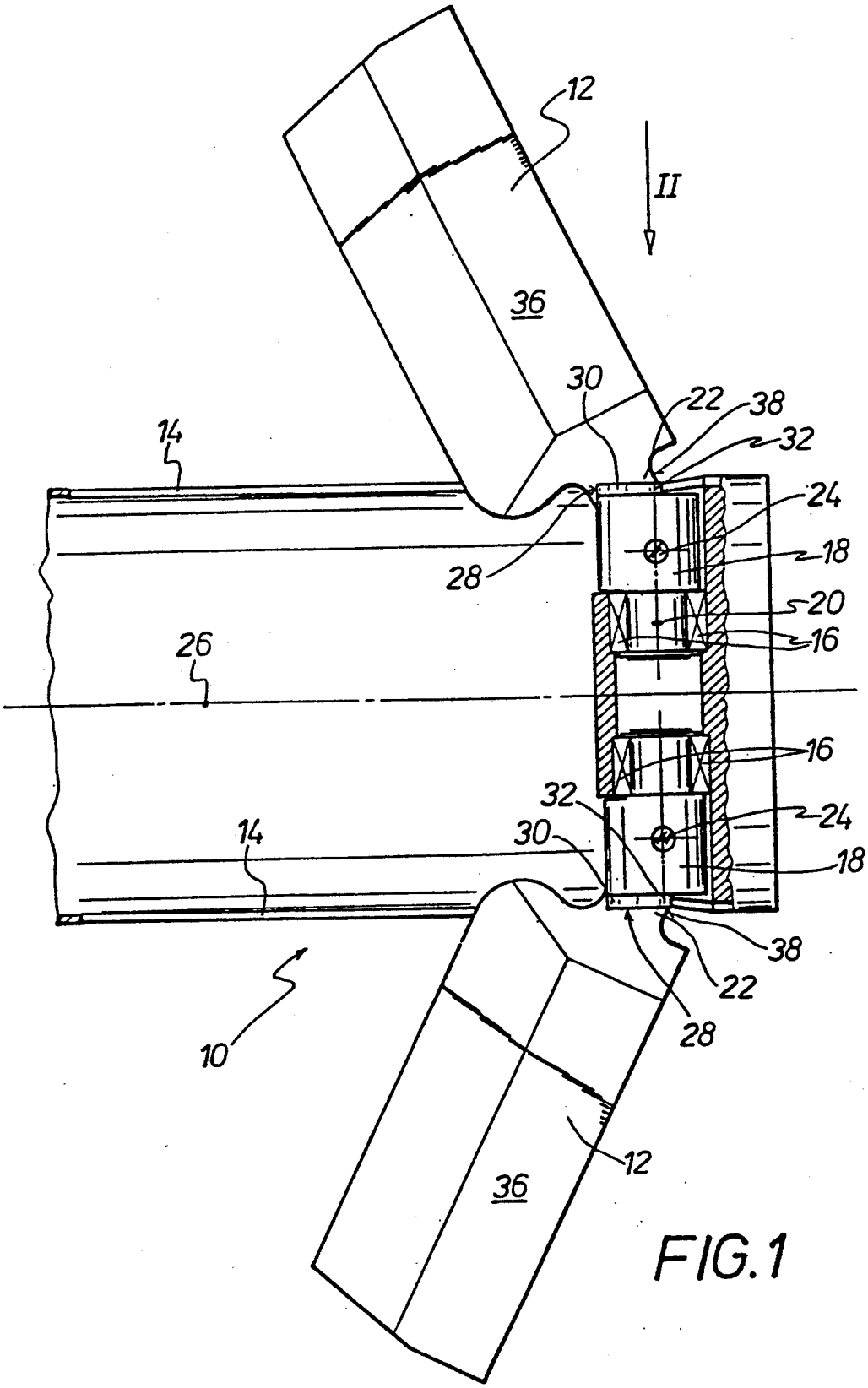
FIG. 1 illustrates a side view of a fragmentary portion and part sectionally shown airborne body with two stabilizing fins or control surfaces, which are represented in an intermediate position between their retracted inoperative position and their flying position in which they are extended away or unfolded from the airborne body.

FIG. 1 illustrates the tail end portion of an airborne body 10 which possesses two stabilizing fins or control surfaces 12. The airborne body 10 is formed with two opening slits 14 through which the stabilizing fins 12 are extendable or unfoldable from the airborne body 10. In the airborne body 10 there are supported shafts 18 for the stabilizing fins through the intermediary of bearing devices 16, wherein the shafts are oriented along the radial direction of th airborne body 10 and are pivotable about an axis of rotation 20. Each stabilizing fin 12 has its vane footing 22 pivotally supported on the associated control surface shaft 18 with the aid of a bearing axle 24. Each bearing axle 24 is perpendicularly oriented relative to the associated axis of rotation 20.

Each stabilizing fin or control surface 12 has a damping or, in essence, latching arrangement 28 associated therewith, which is provided for implementing the unfolding movement of the associated stabilizing fin 12 from its inoperative position in which it is retracted into the airborne body into the flying position in which it extends radially from the airborne body 10, and for the latching of the associated stabilizing fin 12 in the abovementioned flying position.

Figure 2:
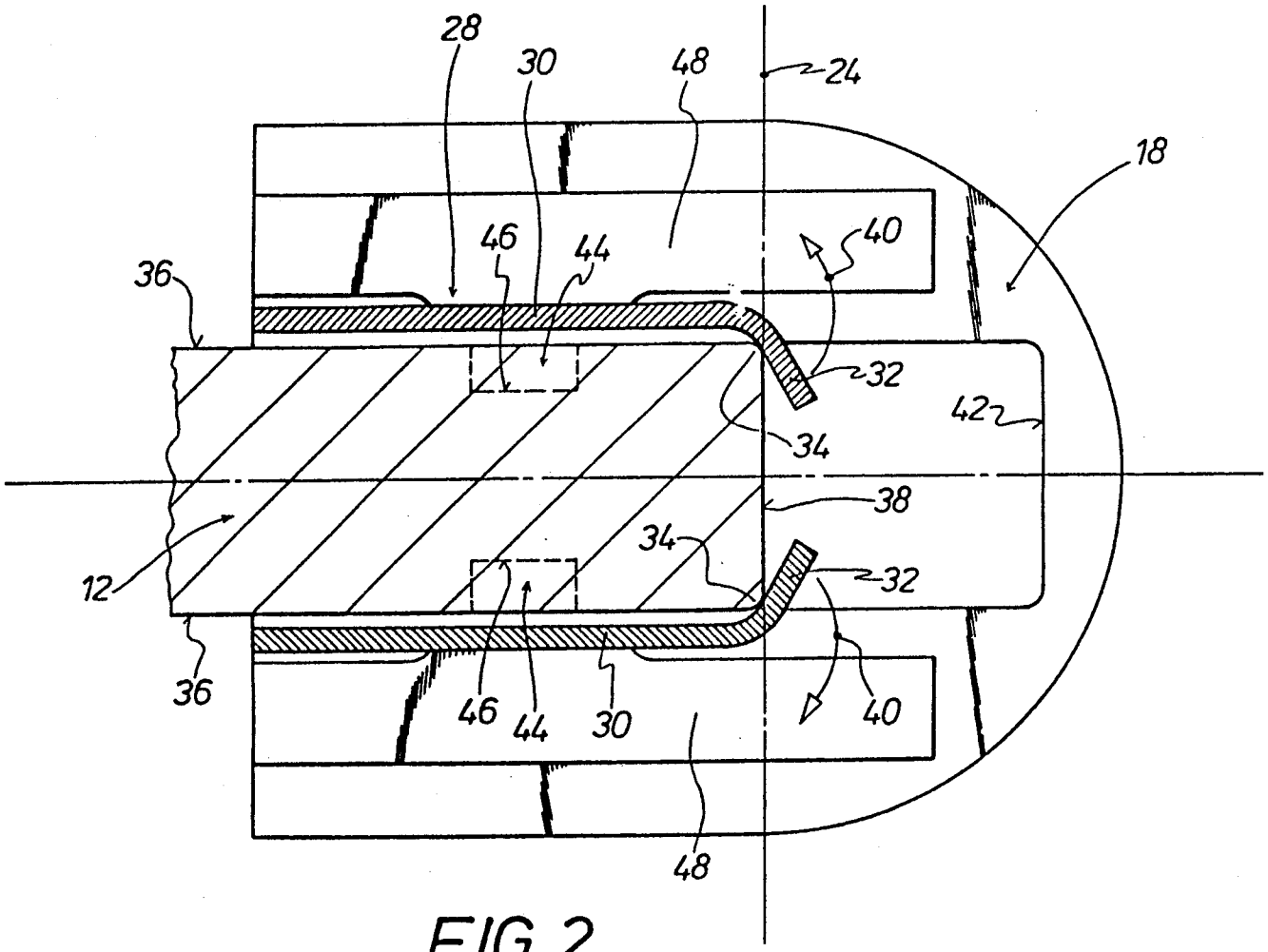
FIG. 2 illustrates, on an enlarged scale, a view in the direction of arrow II in FIG. 1, whereby the partly shown stabilizing fin and the therewith associated damping or latching arrangement are represented in a sectional view and the airborne body has been omitted for purposes of clarity.
Figure 3:
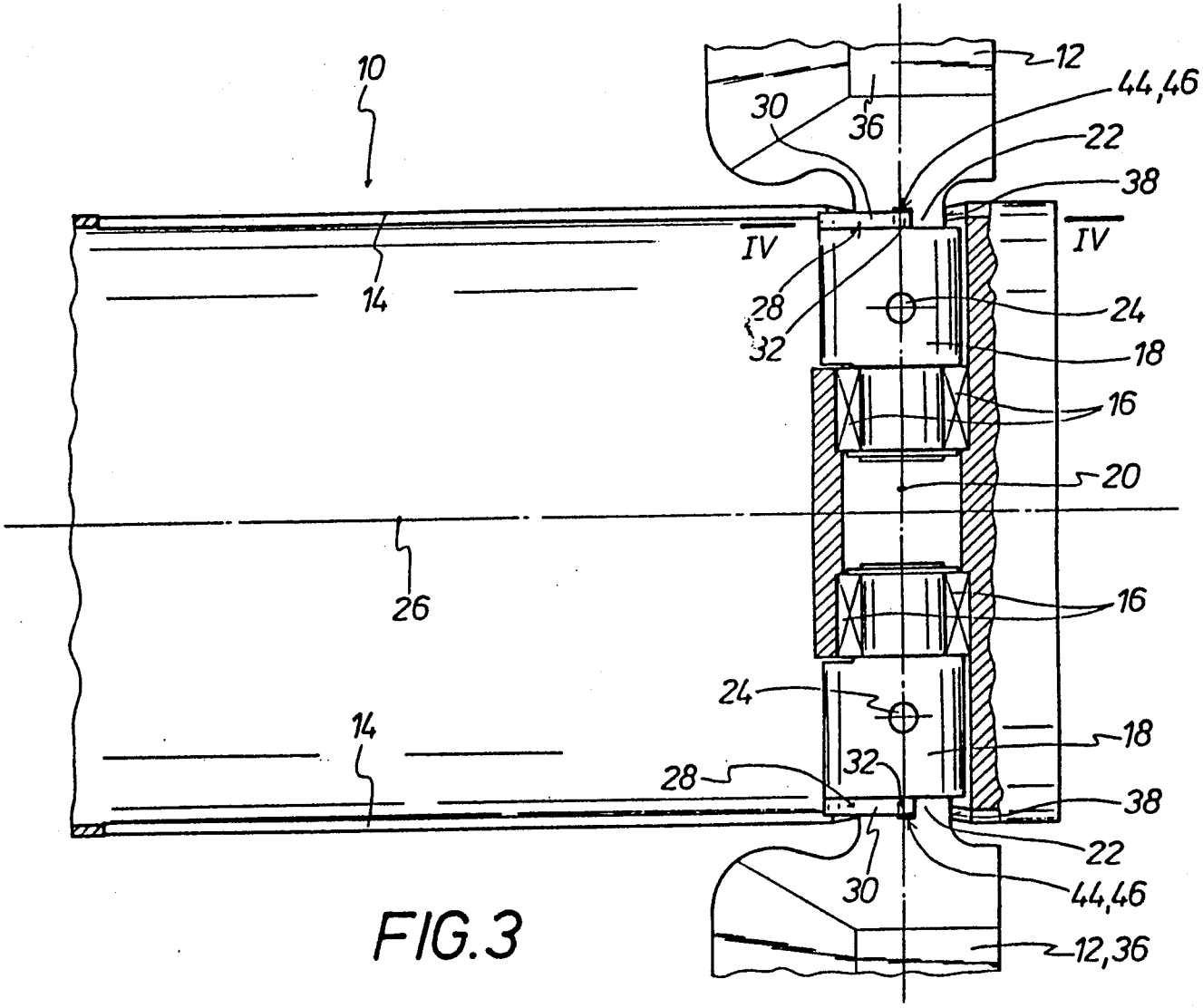
FIG. 3 illustrates a representation similar to FIG. 1; however, in which portions of the stabilizing fins are shown in their flying position in which they are unfolded from the airborne body.

FIG. 2 illustrates a segmentary portion of a stabilizing fin 12 as well as the two damping or latching arrangements 28 for the mentioned stabilizing fin, and which arrangements possess two spring elements 30. The stabilizing fin 12 is pivotably supported on the associated stabilizing fin or control surface shaft 18, whereby the bearing axle 24 is represented through only its central longitudinal middle line. From FIG. 2 there can be ascertained that each spring element 30 possesses a latching portion 32. The latching portions 32, during the extending or unfolding movement of the stabilizing fins, lie against the transitional edges 34 which are present between the side surface 36 and the back surface 38; in effect, against the side surfaces 36 of the respective stabilizing fin 12. The mutually-facing latching portions 32 of the two spring elements 30 of a damping or latching arrangement 28 are bent apart during the unfolding movement of the associated stabilizing fin 12 into the direction of the arrows 40, whereby the latching portions 32 press with a certain amount of force against the side surfaces 36 of the stabilizing fin 12. This force produces a frictional force through which there is produced a reduction or attenuation in the kinetic energy of the stabilizing fin 12.

Figure 4:
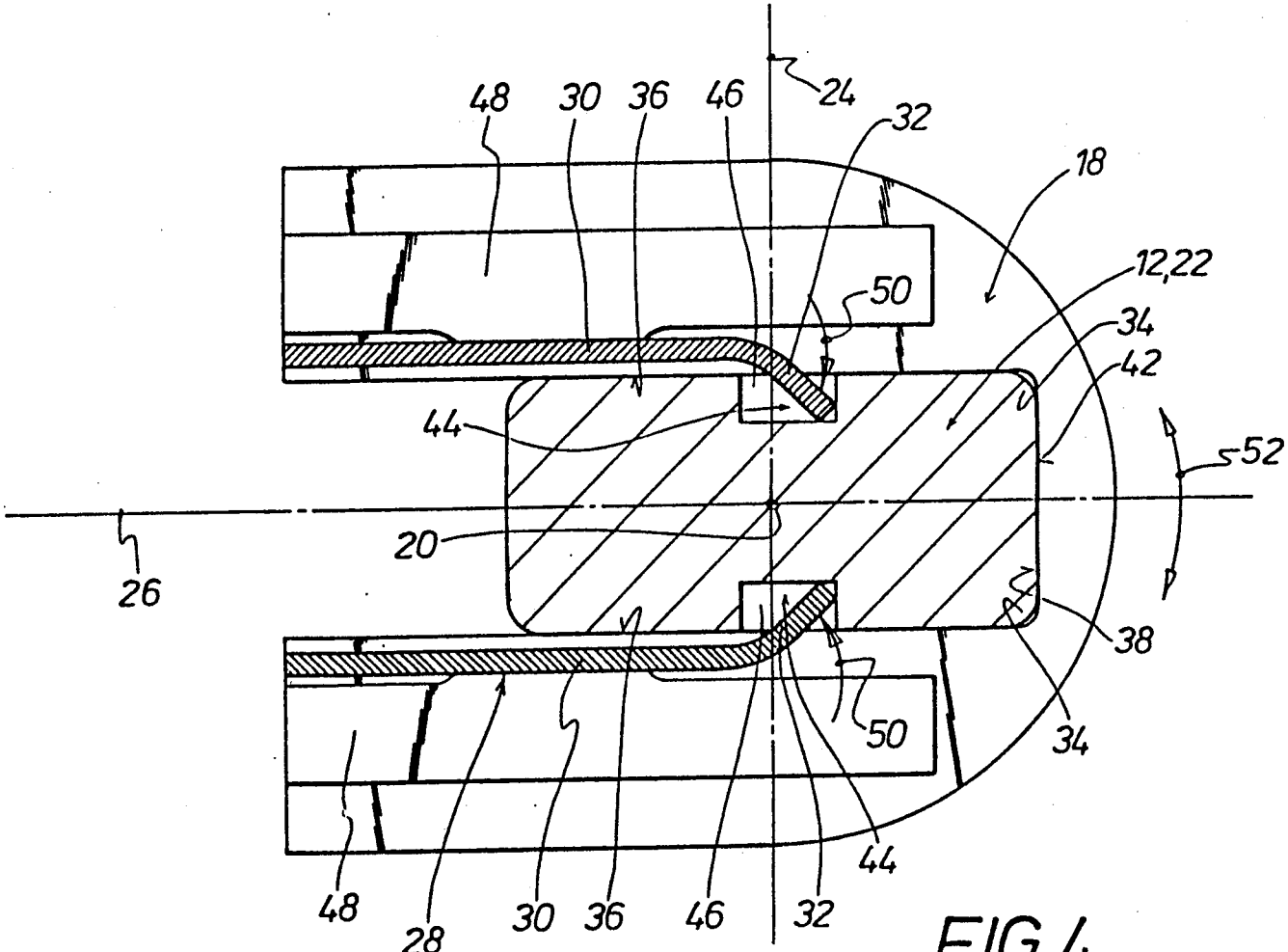
FIG. 4 illustrates, on an enlarged scale, a sectional view taken along line IV—IV in FIG. 3.

In the unfolded flying position for the stabilizing fins 12, in which the back surface 38 of each stabilizing fin 12 comes into contact against a stop or contacting surface 42 on the associated stabilizing fin shaft 18, the elastically resilient, prestressed latching portions 32 of the spring elements 30 of the applicable damping or latching arrangement 28 engage into an associated latching portion 44, as can be particularly clearly ascertained from FIG. 4. The latching portions 44 are formed by cutouts or recesses 46 in the two side surfaces 36 of the respective stabilizing fin 12 which face away from each other.

The spring elements 30 of the damping or latching arrangement 28 of each stabilizing fin 12 are fixed on the respectively associated stabilizing fin shaft 18. For this purpose, each stabilizing fin shaft 18 can be formed with a suitable mounting attachment 48.

In FIGS. 1 through 4 the same or similar components are each identified by the same reference numerals.

In FIG. 4 there are represented arrows 50, through which there is indicated the elastically resilient engagement of the latching portions 32 of the spring elements 30 into the cutouts 46 indicated in the position of flight of the stabilizing fins or control surfaces 12 in which they extend from the airborne body 10. The double-headed arrow 52 in FIG. 4 signifies the capability in the rotation of the stabilizing fin shaft 18 about the axis of rotation 20 of the applicable stabilizing fin 12, which is perpendicular to the bearing axis 24 and the longitudinal axis 26. In FIG. 4, there is also ascertainable the narrow contacting of the back surface 38 of the stabilizing fin 12 against the contact surface 42 on the stabilizing fin shaft 18.

What is claimed is:

1. Airborne body with stabilizing fins, each said stabilizing fin being displaceable about an associated bearing axle between a retracted inoperative position and a flying position in which said stabilizing fin is unfolded from said airborne body; means being operatively connected with each said stabilizing fin for effectuating a damping of the unfolding movement of the stabilizing fin associated therewith from the inoperative position into the flying position and for latching the stabilizing fin in the flying position, each said means including first and second elongate spring elements positioned on opposite sides of said stabilizing fin, each said spring element having a latching portion and the therewith associated stabilizing fin including a latching section cooperable with said latching portion in the extended position of the stabilizing fin, said latching portion of the spring elements comprising free bent end sections extending towards each other in contact with a back surface at a foot end of said stabilizing fin during unfolding of said stabilizing fin from the retracted inoperative position into the flying position thereof, each said latching section on the stabilizing fin including a cutout formed in respectively each opposite side surface of the stabilizing fin facing towards and being axially located offset from said free bent end section of each spring element such that the latching portion of a respective spring element engages therein responsive to rotation of the stabilizing fin about the bearing axle into the extended flying position of the stabilizing fin whereby said bent end portion of each respective spring element is bent open opposite resilient biasing pressure exerted by each spring element against the opposite side surfaces of the therewith associated stabilizing fin during the unfolding thereof under a continuous conversion of kinetic energy generated by the sliding of the bent end portions of the spring elements along the stabilizing fin into frictional energy until said bent end portions of said spring elements engage into the therewith associated cutouts in the opposite sides of said stability fin so as to latch the stabilizing fin in the extended position thereof.

2. Airborne body as claimed in claim 1, wherein each said stabilizing fin has said bearing axle for support of said fin on a stabilizing fin shaft, said damping and latching means being arranged on said stabilizing fin shaft.

* * * * *